US011420796B2

(12) United States Patent
Koesters et al.

(10) Patent No.: US 11,420,796 B2
(45) Date of Patent: Aug. 23, 2022

(54) RECYCLABLE BAG

(71) Applicants: Jens Koesters, Wallenhorst (DE); Immo Sander, Wiesbaden (DE); Michele Lucchese, Mainz (DE)

(72) Inventors: Jens Koesters, Wallenhorst (DE); Immo Sander, Wiesbaden (DE); Michele Lucchese, Mainz (DE)

(73) Assignees: MONDI AG, Vienna (AT); WERNER & MERTZ GMBH, Mainz (DE)

( * ) Notice: Subject to any disclaimer, the term of this patent is extended or adjusted under 35 U.S.C. 154(b) by 405 days.

(21) Appl. No.: 16/510,894

(22) Filed: Jul. 13, 2019

(65) Prior Publication Data

US 2020/0031527 A1 Jan. 30, 2020

(30) Foreign Application Priority Data

Jul. 13, 2018 (EP) ..... 18183447

(51) Int. Cl.

| | |
|---|---|
| ***B65D 33/00*** | (2006.01) |
| ***B65D 75/00*** | (2006.01) |
| ***B65D 75/56*** | (2006.01) |
| ***B65D 75/58*** | (2006.01) |
| ***G09F 3/02*** | (2006.01) |

(52) U.S. Cl.

CPC ..... *B65D 33/004* (2013.01); *B65D 75/008* (2013.01); *B65D 75/566* (2013.01); *B65D 75/5883* (2013.01); *G09F 3/02* (2013.01); *B65D 2203/02* (2013.01); *G09F 2003/0269* (2013.01)

(58) Field of Classification Search

CPC ..... B65D 75/008; B65D 75/566; B65D 75/5883; B65D 2203/02; B65D 2501/24878; B65D 2501/24885

See application file for complete search history.

(56) References Cited

U.S. PATENT DOCUMENTS

| | | | | |
|---|---|---|---|---|
| 3,114,643 | A | 11/1961 | Boston | |
| 3,744,383 | A * | 7/1973 | Finch | B31B 70/00 493/196 |
| 3,994,089 | A * | 11/1976 | Schwartz | G09F 3/0289 40/310 |
| 5,823,683 | A * | 10/1998 | Antonacci | B65D 33/004 383/107 |

(Continued)

FOREIGN PATENT DOCUMENTS

| | | |
|---|---|---|
| EP | 2032454 B | 1/2013 |
| EP | 2364848 B | 8/2013 |

*Primary Examiner* — Derek J Battisti

(74) *Attorney, Agent, or Firm* — Andrew Wilford

(57) ABSTRACT

Front and back panels have side seams that fix the panel side edges of the front panel to the panel side edges of the back panel and each extend a full vertical length of the respective panel side edges. A label formed from a separate piece of film covers one of the face panels between the side edges thereof, is disconnected from the one face panel between the panel side seams, has label side edges generally at the respective side panel edges, and secures the label to the one face panel. Respective secondary side seams are provided between the side edges of the label and the side edges of the one panel, and respective tear lines are formed in the label closely adjacent and generally parallel to each of the label side edges. There is printing on the label only between the tear lines.

20 Claims, 4 Drawing Sheets

(56) References Cited

U.S. PATENT DOCUMENTS

| | | | | |
|---|---|---|---|---|
| 6,230,968 | B1 * | 5/2001 | Varadarajan | B65D 3/22 206/830 |
| 6,280,085 | B1 | 8/2001 | Beer | |
| 2016/0083145 | A1 * | 3/2016 | Murray | B31B 70/60 383/105 |
| 2017/0144800 | A1 * | 5/2017 | Lucchese | B65D 75/5883 |
| 2018/0009587 | A1 | 1/2018 | Mosser | |

* cited by examiner

RECYCLABLE BAG

CROSS REFERENCE TO COPENDING APPLICATIONS

This application is related to patent application Ser. No. 15/348,711 filed 10 Nov. 2016 with a claim to the priority of European patent application 15194573 filed 13 Nov. 2015.

FIELD OF THE INVENTION

The present invention relates to a bag. More particularly this invention concerns a bag that is made of plastic film and that can be recycled.

BACKGROUND OF THE INVENTION

A film bag typically has a body made of film and having at least two opposing wall panels, an indicia-carrying piece of label film on a part of a peripheral edge of the label is attached by permanent label seams to one of the wall panels and has a tear line in the form of a weakening in the material adjacent each label seam.

The film bag is designed in particular as a film packaging bag and can be provided, for example, with a stand-up bottom for accommodating liquids such as detergents, cleaning agents, liquid soap, shampoo, shower gel, conditioner or the like. However, in addition to other liquids, such as various household chemicals, other packaging purposes for which film bags may be used in a known way may also be considered.

Packaging bags are used in practice as mass-produced items with the typical design of such film packaging bags being known for example from EP 2 032 454 and EP 2 364 848.

The material of the bag walls is often a lamination composite forming a bag film with an inner film of polyethylene (PE) and an outer film based on polyethylene terephthalate (PET) or biaxially oriented polypropylene (BO-PP). The print for such a lamination composite is applied either to the outer film or to the inner film and is then visible through the transparent outer film before the inner film is bonded to the outer film on the contact surface.

Such traditional film packaging bags are characterized by a particularly high-quality appearance and good function properties. However, because of the lamination of the different polymer materials, homogeneous plastic recycling is impossible, which is why corresponding film packaging bags are usually discarded by dumping or, at best, incinerating them as disposable items after use so that thermal utilization is possible at least in the latter case.

However, single-origin plastic waste can be recycled easily but then the printing ink often present on the bag wall may prevent the production of high quality recycled products depending on the composition of the printing ink.

Single-origin and unprinted plastic wastes are particularly advantageous from the standpoint of recycling and reuse. However, with film bags and in particular film packaging bags, there is often the need for a high-quality appearance, and product and use information must also be provided on the film bag in addition to its attractive graphical design.

To meet these demands, different approaches, often in different directions, are known. According to JPH 5-84640 U, a film bag for refilling with a liquid is proposed where the bag is provided with a separate label wrapped around it. The film bag is stabilized by the separate, comparatively stiff sleeve of the label, and the user can also grip the film bag well by the label.

In addition, there are known multilayer film bags and film packaging in which individual layers are joined in such a way that they can be peeled off, i.e. they can be separated from one another. To do so, label seams are created, such that their composite adhesion is adjusted, these label seams being separated when a tensile force is applied to the contact surface of the successive layers. Various embodiments of such film bags and film packaging are described for example in JPH 8-2536A, US 2018/0009587, U.S. Pat. Nos. 3,114,643 and 6,280,085.

In addition, a generic film bag is known from (FIG. 1). The printed label extends over only one central region with regard to the height of the film bag and is secured there on the front panel beneath it by permanent, i.e., unpeelable, label seams in the form of welds. The two wall panels opposite one another are each preferably provided with a printed label, and such an embodiment is also particularly preferred within the scope of the present invention.

When the known generic film bag has been emptied, for optimal recycling, the largest portion of the indicia-carrying label can be torn away along tear lines that run directly adjacent to the thermal welds on the longitudinal side panel edges. Narrow edges of the label remain only directly on the welds. If the label there has intentionally not been printed, then the bag body that remains after peeling away the label is completely unprinted. Simple recycling is then possible in the case of a separate embodiment.

OBJECTS OF THE INVENTION

It is therefore an object of the present invention to provide an improved film bag.

Another object is the provision of such an improved film bag that overcomes the above-given disadvantages, in particular that is easily recycled.

SUMMARY OF THE INVENTION

A bag has according to the invention front and back panels each formed of film and having upper and lower normally horizontal panel edges and normally vertical and generally parallel side panel edges bridging outer ends of the upper and lower panel edges. Respective panel side seams fix the panel side edges of the front panel to the panel side edges of the back panel and each extend a full vertical length of the respective panel side edges. A label formed from a separate piece of film covers one of the face panels between the side edges thereof, is disconnected from the one face panel between the panel side seams, has label side edges generally at the respective side panel edges, and secures the label to the one face panel. The label has a longitudinal dimension at the label side edges equal to between 40% and 98% of the vertical length of the respective side edges. Respective secondary side seams are provided between the side edges of the label and the side edges of the one panel, and respective tear lines are formed in the label closely adjacent and generally parallel to each of the label side edges. There is printing on the label only between the tear lines so that a portion of the label between the label side edges and carrying the printing can be torn from the bag to leave only scraps of the label adhering to the bag at the panel side edges.

According to US 2017/0144800, starting from a rectangular shape of the label in the manner of a sleeve label, a label seam is intentionally provided only on the short side edges of the sleeve label, whereas the label seam according to the present invention extends over an amount between 40% and 98% of the edge so that there is a better and more thorough fastening of the label on the front panel on the whole.

In this context, the present invention is based on the discovery that the strength of the embodiment known from the prior art is sufficient per se, but there is a long unconnected length between the label and the front panel over the entire width of the film bag on the longitudinal sides of the label in the manner of a sleeve label.

With such a long unconnected length in particular, there is the risk that the piece of label film might somehow catch on something so that the label is torn away during use of the film bag, for example, during transport or handling by the user, despite the fact that it is basically secured adequately.

Furthermore, according to the prior art, the label can be peeled away from the underlying front panel due to the considerable unconnected length. For example, this is true if there is greater mobility after partial removal of the filling material from the film bag, and in particular the bag body can no longer be filled tightly. Even the resulting negative visual effects (with an even greater risk of catching as described above) are avoided within the scope of the invention by the larger proportion of the label seam along the peripheral edge.

The label seam preferably extends over an amount of at least 50% and especially preferably at least 60% of the peripheral edge.

Since the label is connected by a permanent, i.e. inseparable, label seam on the front panel, a free location must remain in the label seam along the peripheral edge so that the user can insert a finger or two here between the separate label and the front panel to then be able to pull off the label or the part of the label within the tear-away line of the front panel. Accordingly, the label seam preferably extends over at most 90% and especially preferably at most 85% of the peripheral edge.

The label seam and the tear line may each have a plurality of label-seam sections and/or tear-line sections spaced a spacing apart from one another along the peripheral edge. The amount of label seam along the peripheral edge is then obtained from the total of the lengths of all label-seam sections.

Wherever the label seam (and/or label-seam sections) is provided along the peripheral edge of the label, the tear line and/or the tear line sections also run next to them with an inward offset because otherwise the separation of material desired in peeling off the label cannot be ensured.

If the label seam is formed from a plurality, preferably at most six, label-seam sections, then the label-seam sections are especially preferably each designed to be continuous. Alternatively, however, the label-seam sections may fundamentally each be designed to be continuous as a weakening of the material like a perforation and having connected regions alternating with unconnected regions.

Within the scope of the present invention, the term "label-seam section" is always understood to refer to a length along the peripheral edge over which a continuous tear is formed along the tear line in peeling the label away from the front panel. However, in the case of successive connected and unconnected sections, if the tear reaches the outer edge of the label in peeling away the label, then there is also a break in the label seam there in the sense of the present invention. As long as the tear propagates along the label seam in peeling material away along the tear line, it ultimately does not matter whether this is continuous or discontinuous, although a continuous embodiment is preferable in practice.

Even if different embodiments may be considered for the label seam, it is preferably a thermal weld. The bag film is then expediently thermally weldable at least on the inside and on the outside of the bag, in which case the wall panels and optionally gusset folds between the wall panels and/or function shapes, such as a pour spout or a reclosing strip, can then be shaped fit with the bag body by thermal welding.

According to a preferred embodiment of the invention, in order for the label to be peelable as thoroughly as possible from the front panel after the film bag has been used, the tear line runs at a spacing of between 4 mm and 20 mm, preferably between 6 mm and 12 mm, up to a neighboring outside edge of the label. The spacing described here is selected so that the connecting seam, in particular in the form of a weld, can be formed between the tear line and the respective neighboring outside edge of the label. The tear line may be formed by perforations, by notching or by laser burning or weakening. In the case of perforations, cuts and webs alternate in rapid sequence along the tear line.

In a type of notching that is like serration, the label has a lesser thickness at the tear line. This may be achieved, for example, by partially cutting the label in the thickness direction there. In addition, a displacement of material may be created by embossing, for example. The measures described here may also be combined with perforations in particular. For example, weakened areas may alternate with unweakened areas in the manner of perforations along the tear line. To make it particularly easy to tear along the line, weakened regions may alternate with completely through-cut regions to form perforations.

In addition, the tear line may also be formed by a laser. Then removal of material and/or embrittlement of material is/are achieved by lasing the material. When using a laser, the label may also have absorbent additives so that the tear line can be formed especially effectively without damaging the material of any additional optional layers. Embrittlement is fundamentally also possible by application of temperature. In thermal welding, the tear line can also be formed directly by heat input and/or by shifting or displacement of material.

As already explained above, accidental peeling of the label and extensive separation of the label from the front panel are to be prevented within the scope of the present invention. Accordingly, it is advantageous if the longest unconnected length between the label and the front panel along the peripheral edge is minimized, preferably so that it amounts to less than 160 mm. The greatest unconnected length is especially preferably between 40 mm and 120 mm.

With regard to the lower limit, it should be pointed out that, in at least one location in the label, the user should have the option of inserting at least one finger between the label and the front panel to be able to pull the unconnected part of the label from that location by a peeling movement.

The largest unconnected length is preferably located in an upper area of the film bag, especially preferably in the area of an upper corner of the bag. Such an arrangement reduces the risk of inadvertently peeling (a piece that is caught) in such a way that the user will search for a point of contact to peel away the label precisely in the upper area of the bag, and in particular at one corner of the bag.

In one typical embodiment, the wall panels have an approximately rectangular shape with two side edges, an upper edge and a lower edge. In particular, if the film bag is provided for holding liquid, the upper corners of the wall panels may be cut off obliquely, as known from above-cited US 2017/0144800 and US 2018/0009587, for example. Such wall panels are also referred to there as being essentially rectangular within the scope of the invention.

Basically the label can be provided in various ways on the front panel. In particular, the possibility of the label being set at a spacing from the edges of the front panel cannot be ruled out. According to a preferred embodiment of the invention, however, the label extends at least up to one of the edges of the front panel.

The label especially preferably extends up to the side edges, the lower edge and the upper edge of the front panel so that the label is then also attached to each of the edges with the label seam in at least some sections.

With respect to a rectangular or essentially rectangular design of the wall panels, the label is then held along all edges and is thus well protected against inadvertent peeling. In addition, the front wall is covered by the label extensively, almost completely or even completely, to yield a particularly high-quality appearance for the user, similar to that obtained with a traditional film bag, although the later cannot be recycled in the same way.

If the label extends up to at least one edge and preferably all edges of the front wall, the label seam usually also corresponds to a connecting seam in at least some sections, where the wall panels are connected either to one another directly or with a fold arranged between the wall panels. In particular when the film bag is provided for holding liquids, a bottom fold may be provided between the wall panels and then this also forms a standing bottom.

The label may have a rectangular or essentially rectangular shape. In a particularly preferred embodiment, at least one corner is separated obliquely starting from a rectangular shape. It may also be appropriate if the label at the obliquely severed corner springs back with respect to the front wall beneath it. For example, the label seam may be interrupted along an unconnected length in such a setback region to provide a gripping area for the user for peeling away the label.

The setback configuration of the label may also be expedient when a functional depression is provided in the area of the bag body beneath that. A pour spout, a carrying handle, a grip hole, or a reclosable strip fastener may be considered as a functional shape in particular.

Whereas pour spouts and reclosing strips are supplied as separate parts, a carry handle may be formed in various ways. In addition to the fastening of a grip loop supplied separately, a carrying handle can also be formed easily by punching or by cutting in a particularly preferred manner. Such a punched out or cut out handle is then expediently formed in an area that is separated from the actual holding space of the bag body by a weld. Reference is made in this regard to above cited US 2017/0144800 as an example.

Within the scope of the present invention it may be sufficient if just one of the two wall panels is provided with a label in the manner described here, minimizing the use of material as part of such a design and then only an indicia-carrying label need be removed. The disadvantages of printing in the context of recycling were already discussed in the introduction in discussing the known embodiments.

However, according to a preferred refinement of the invention, both wall panels are provided with a respective label which may be designed to be the same or different with regard to the features described above.

Such a circumstance takes into account the requirement that film bags should usually be designed differently on the front and back. Whereas the product may be provided with an attractive design, a logo and an easy-to-read label on the front, detailed information about the ingredients, use, other properties, warnings and the like may be listed on the back.

To facilitate recycling in particular, the bag film may be formed of pure polyolefin. For all the components of the film bag and in particular the bag film and the label, recycled products or blends containing recyclable materials may be considered for use.

The bag body itself is preferably also unprinted.

Against this background it is also advantageous if the label is unprinted in the area of the label seam and in particular outside the tear line although printing is not fundamentally ruled out there. If the label outside of the tear line is unprinted, then the result is that no printing ink remains behind even when scraps of the label remain on the bag body after the label has been peeled off. It may also be provided that the label and the bag film are all formed from pure polyolefin in which case then on the whole the residual material is pure and unprinted when the label with its printed areas has been separated from the bag body.

According to a preferred embodiment of the invention, the label is made of film. Alternatively, however, other materials, for example, nonwovens, coated paper and a multilayer laminate may also basically be considered.

The label seam or the sections forming the label seam provided on the peripheral edge are usually provided as the only connection between the label and the front wall beneath it.

Even if the label can contribute to some extent to stabilization of the bag body, it still preferably has a much lower thickness in comparison with the bag film and has a much lower weight per unit of area.

Within the context of such an embodiment, the fact that the label can also be recycled, the resulting recycled material is of a lower quality because of the printing ink residues and the possible uses of the recycled material are limited as a result must also be taken into account in such an embodiment.

The weight of the label per unit of area is typically between 18 $g/m^2$ and 150 $g/m^2$, which is much lower than the similar weight/area ratio of the face films. In a preferred embodiment of the label as a film and with the usual plastics, this weight per unit of area corresponds approximately to a thickness between 20 μm and 170 μm.

The bag film preferably has thickness between 80 μm and 300 μm, especially preferably between 100 μm and 250 μm. The weight/are ratio is proportionately larger than that of the label.

The choice of a suitable thickness for the bag film also depends to a particular extent on the size of the film bag, the intended purpose and the loads to be expected. With an increase in the size of the film bag, in case of doubt a greater thickness of the bag film and optionally also of the label must be taken into account.

If the label is designed as a film, then it especially preferably amounts to at most half the thickness of the bag film.

A longitudinal direction and a transverse direction can be assigned to the film bag according to the invention. With essentially rectangular wall panels, the longitudinal direction then corresponds to the normally vertical extent of the side edges of the wall panels, with the normally horizontally upper and lower edges extending transversely.

Starting from such an assignment of the longitudinal direction and the transverse direction, the label is preferably provided with the label seam continuously along both of its side edges running in the longitudinal direction, this label seam also extending to the upper edge and to the lower edge in at least some areas. A continuously seam is also possible along the lower edge. However, it may be sufficient if only individual partial areas are attached at the lower edge and then each one forms a separate comparatively short label-seam section.

As explained above, it is essential according to the invention that the label having the label seam is attached permanently to the front panel so that when the label is peeled away, the material is separated at the tear line and therefore scraps of the label remain on the front wall. It is possible in particular and in many cases it is preferable for the label seam to be the only connection between the label and the front panel.

According to an alternative embodiment, additional connecting points are provided on the surface of the label, for example, in order for the label not to be able to lift up and separate too far from the front panel so that the appearance might be impaired.

Additional connecting points or connecting locations may be formed in various ways. Whereas the permanent label seam is provided along the peripheral edge of the label, a peelable fastening may also be provided on the optional additional optional connecting locations or points. A peelable thermal weld seam may be formed, for example, by precisely selected sealing parameters, light and/or providing a coating that reduces the sealing strength. These variants are mentioned only as an example. A permanent or peelable connection is also possible by use of adhesive.

If at least one additional connection is created by adhesive or by thermal welding within the area of the label within the scope of the variants described here, then this is expediently also surrounded by line of weakened material like the tear line or perforations along the label seam. When the label is then peeled away, individual islands also remain within the area of the label that remain in place in addition to the scraps of the label at the edges along the label seam and then are not printed according to a preferred embodiment of the invention so that the remaining bag body with the scraps of the label is then ideally completely free of printing ink.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
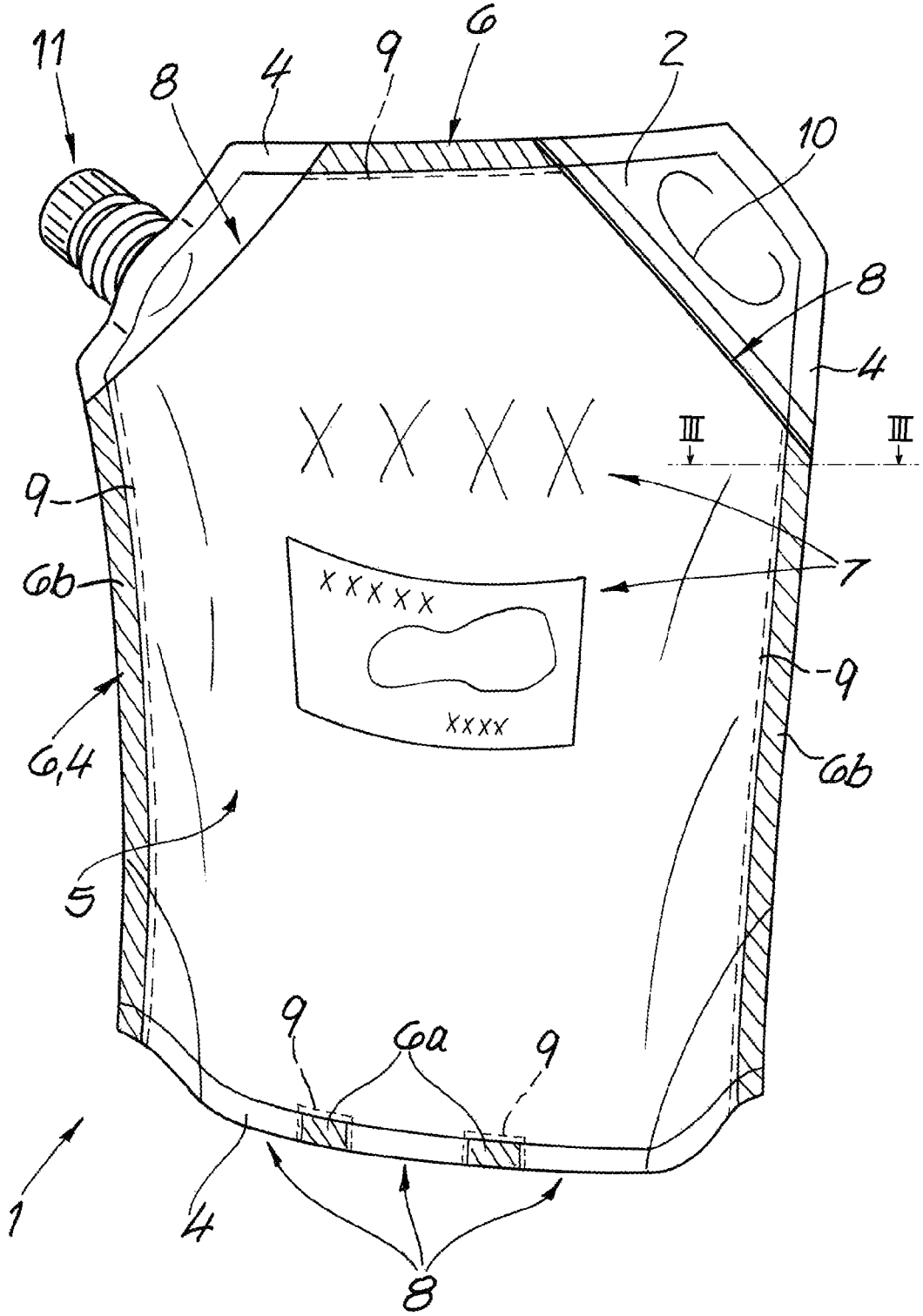
FIG. 1 is a front elevational view of a filled film bag according to the invention.
Figure 2:
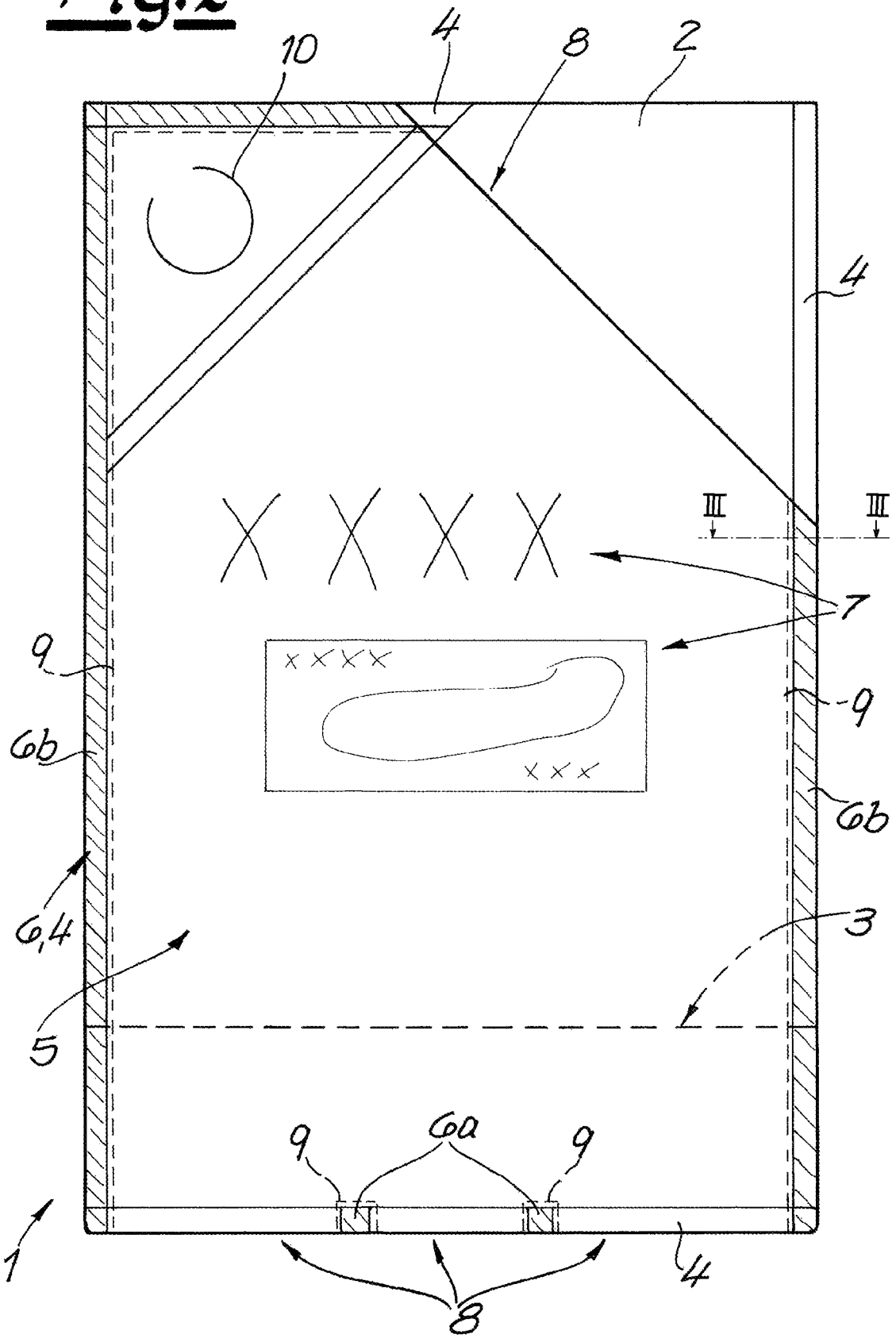
FIG. 2 is a view like FIG. 1 of an alternative embodiment of the film bag in a flat unfilled condition.

FIGS. 1 and 2 show alternative embodiments of a film bag. By way of contrast there is a somewhat different shape as well as the fact that the film bag according to FIG. 2 is flattened, unfilled, unsealed and is not provided with an additional function element. FIGS. 1 and 2 may however also be considered in their totality with respect to the remaining design.

Accordingly it can be seen that the bag has a body 1 with front and back wall panels 2 opposite one another and a folded floor gusset 3 between lower edges of the wall panels 2. The wall panels 2 are connected at their normally vertical side edges and normally horizontal bottom edges to one another and to the bottom fold 3 by seams 4, normally welds.

In addition it can be seen that a separate indicia-carrying label 5 is provided on the front wall 2. As can also be seen in FIG. 3, the label 5 is fastened to the normally longitudinal side edges of the front wall 2 by weld seams 6 that overlie with the respective seams 4 connecting together the longitudinal side edges of the panels 2.

The connecting seams 4 and the label seam 6 are each formed by thermal welding. Whereas the label 5 is provided with an indicia or imprint 7 in a central region, the peripheral edges of the label 5 and the entire bag body 1 are clean and unprinted.

In the embodiment according to FIG. 1, the label seam 4 has a total of five label-seam sections **6*a* and 6*b* around the peripheral edge of the label 5, separated from one another by unconnected regions 8. In addition FIG. 1 also shows that the upper corners are cut off obliquely at an angle of about 45° in this embodiment, starting from an approximately rectangular shape of the label 5**.

To this end according to the present invention that the label seam 6 is permanent, i.e. it cannot be peeled off, and a tear line 9 in the form of a weakening in the material runs along the each of the label seams 6, i.e. usually parallel to the label seam 6.

Figure 3:
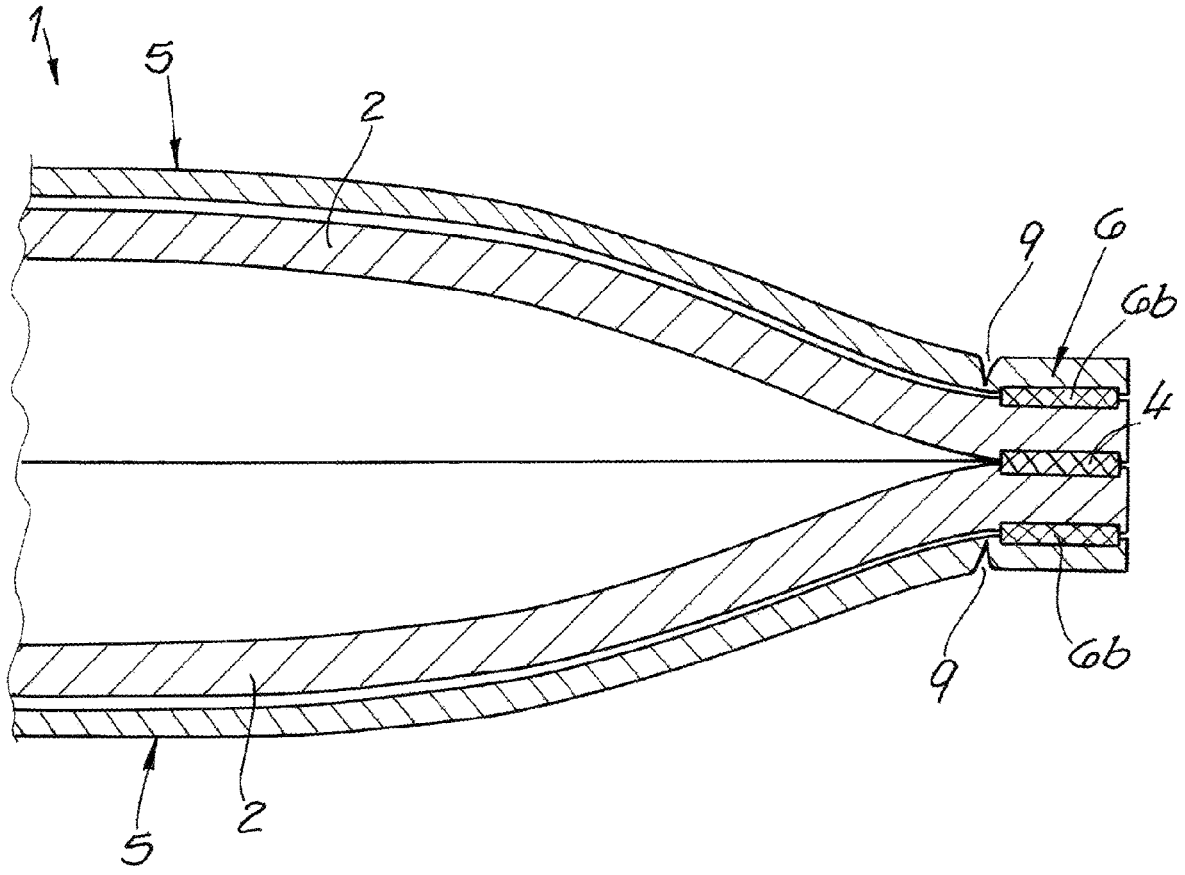
FIG. 3 is a section taken along line of FIG. 1 or 2.

The material weakening may be formed in various ways. For example, perforation and/or a reduction in thickness and/or embrittlement of the material, for example, by lasing or by applying heat are possible options here. More particularly, although for better recognizability, the tear line 9 in FIG. 3 is shown with a reduced thickness of the label 5, but it can also be formed in some other way, for example, by a laser and/or heat input. If the heat is applied in a suitable manner in hot sealing, the result is a particularly simple process management.

Thus if the user grips an upper corner of the bag at one of the regions 8 between the label 5 and the front wall 2 to dispose of it after use of the film bag and then pulls the label 5 outward away from the front panel 2, the result is separation of the label 5 along the tear lines 9 so edge scraps of the label 5 remain on the front wall 2 at label seams 6 up to the tear line 9 while the entire middle part of the label 5 is peeled away along with the printing. Since the imprint 7 ends before the tear line 9, there remains then a bag body 1 completely without printing ink.

The label seam 6 extends over an amount between 40% and 98% of the peripheral edge, and the extent is preferably greater than 50% and especially preferably greater than 60% and is preferably less than 90% and especially preferably less than 85%. Hence the preferred extent is 60% to 85%.

Basically a continuous label seam 6 and/or a continuous fastening section is/are possible along a lower edge of the front wall 2. However, in the embodiment illustrated here, only two short label-seam sections **6*a* are provided as a type of fixation at this lower edge while the label seam 6 with the corresponding fastening sections 6*b*** extends along the side edges of the bag between the obliquely severed corners over the entire vertical length of the label.

FIG. 3 that according to a preferred embodiment of the invention, the label 5 is provided on both the front and back panels 2, and the labels 5 may be designed to be largely the same or different. FIG. 3 also shows that the labels 5 outside of the label seam 6 are not connected to the respective wall 2.

According to the embodiments shown here, the film bag is provided to hold liquids, for example, detergent, shampoo, conditioner, cleaning agent or other household chemicals, as an example of such an application. The embodiment according to the invention is also suitable for other film bags, in particular the usual film packaging bags.

The tear line 9 preferably lies at a slight spacing from the label seam 6, this spacing from the tear line 9 to the respective neighboring outside edge of the label 5 thus being between 4 mm and 20 mm, in particular for example between 6 mm and 12 mm.

The embodiments illustrated in FIGS. 1 and 2 each have a grip hole 10 formed by a molded section in a sealed area of the bag body 1. According to FIG. 2, the label 5 also extends over the grip hole 10 and is also molded there, but this corner area is cut back according to FIG. 1.

FIG. 1 also shows as an example that the bag body has a pour spout 11, but alternative reclosable structures, for example reclosing strip fasteners, may also be provided.

Figure 4:
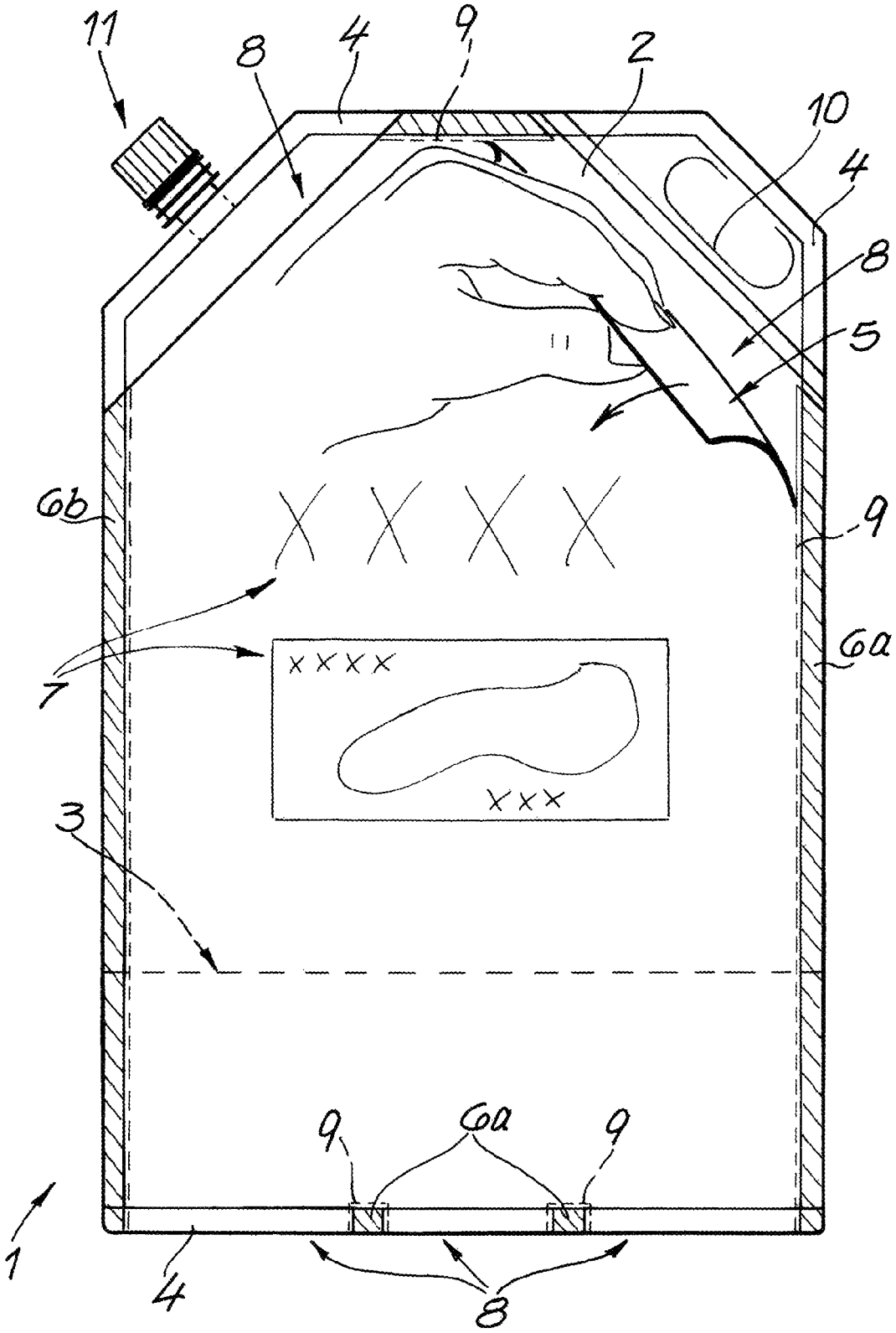
FIG. 4 shows an empty and flattened film bag during while the piece of label film is being peeled away.

As already mentioned above, the bag body 1 that remains according to FIG. 4 having the remaining edge pieces of the label 5 is completely unprinted. It is also possible to produce the label 5 and the wall panels 2 of the bag body as well as the function elements, such as the pour spout 11, from pure polyolefin, for example, polyethylene or polypropylene so that particularly effective recycling is then possible.

The bag film forming the wall panels 2 and preferably also the bottom fold 3 typically has a thickness between 120 μm and 250 μm.

If the label 5 according to a preferred embodiment of the invention consists of a film, then the thickness amounts to between 20 μm and 170 μm, for example.

We claim:

1. A bag comprising:

front and back face panels each formed of film and having a respective peripheral edge formed by upper and lower normally horizontal panel edges and normally vertical and generally parallel panel side edges bridging outer ends of the upper and lower panel edges;

a peripheral panel seam fixing the peripheral edge of the front face panel to the peripheral edge of the back face panel;

a label formed from a separate piece of film, covering one of the face panels within the peripheral edge thereof, disconnected from the one face panel within the respective peripheral edge, and having a label peripheral edge generally at the respective peripheral edge of the one face panel and extending between and fixed thereto at the upper, lower and side edges thereof;

respective label seams securing the peripheral edge of the label to the peripheral edge of the one face panel along between 40% and 98% of a length of the peripheral edge of the one face panel;

respective tear lines formed in the label closely adjacent and generally parallel to the label seams; and printing on the label only between the tear lines, whereby a portion of the label within the label seams and carrying the printing can be torn from the bag to leave only scraps of the label adhering to the bag at the panel peripheral edge.

2. The bag defined in claim 1, wherein the label seams are thermal welds.

3. The bag defined in claim 1, wherein the label seams are formed from at most six label-seam sections that are separated from one another at the upper and lower edges by unconnected edge regions.

4. The bag defined in claim 1, wherein each tear line is spaced between 4 mm and 20 mm from the peripheral edge of the label.

5. The bag defined in claim 1, wherein the label seams are each formed of several seam sections separated by unconnected edge regions at most 160 mm long.

6. The bag defined in claim 5, wherein the unconnected edge regions are between 40 mm and 120 mm long.

7. The bag defined in claim 5, wherein the unconnected region of greatest length is provided at an upper corner of the bag.

8. The bag defined in claim 1, wherein the panels are rectangular, the side edges are parallel, and the label extends to one of the upper and lower panel edges.

9. The bag defined in claim 1, wherein the label extends to the lower and side edges of the one face panel and the label seam includes sections at both the side edges of the one panel and at the upper and lower panel edges.

10. The bag defined in claim 1, wherein most of the label seam directly overlies the panel seam at an outer edge of the one panel, the panel seam further comprising:

respective panel side seams fixing the side edges of the front face panel to the side edges of the back face panel or to a side gusset between the panels.

11. The bag defined in claim 1, wherein the panels are generally rectangular with corners of which one is cut off obliquely.

12. The bag defined in claim 11, wherein the panels are provided at the one cut-off corner with a grip hole or a reclosable fastener.

13. The bag defined in claim 1, wherein there is a respective such label on each of the face panels.

14. The bag defined in claim 1, wherein the panels are made of pure polyolefin.

15. The bag defined in claim 1, wherein the face panels are unprinted.

16. The bag defined in claim 1, wherein the label is made of thermoplastic film, a nonwoven, coated paper, or a multilayer laminate.

17. The bag defined in claim 1, wherein the panels and label are made of pure polyolefin and the label is unprinted at its edges.

18. The bag defined in claim 1, wherein the tear line is formed by a perforation, notching, or by a laser.

19. The bag defined in claim 1, wherein the panels are of a film having a thickness between 80 μm and 300 μm.

20. The bag defined in claim 1, wherein the label has a weight per unit of area between 18 $g/m^2$ and 150 $g/m^2$.

* * * * *